United States Patent [19]

Gavel et al.

[11] 4,196,948

[45] Apr. 8, 1980

[54] CONSTRUCTION ELEMENT FOR FURNITURE AND LIKE INTERIOR FITTING DETAILS

[75] Inventors: Margareta Gavel; Peter Gavel, both of Stockholm, Sweden

[73] Assignee: Gavels Arkitektkontor AB, Stockholm, Sweden

[21] Appl. No.: 889,502

[22] Filed: Mar. 23, 1978

[30] Foreign Application Priority Data

Mar. 28, 1977 [SE] Sweden ..... 7703528
Mar. 28, 1977 [SE] Sweden ..... 7703529

[51] Int. Cl.[2] ..... A47B 87/00; A47B 43/00

[52] U.S. Cl. ..... 312/107; 312/111; 312/257 R; 52/539

[58] Field of Search ..... 312/111, 107, 108, 206, 312/257 R, 257 SK, 257 A; 52/539, 529, 530

[56] References Cited

U.S. PATENT DOCUMENTS

| | | | |
|---|---|---|---|
| 1,627,084 | 5/1927 | Fritz | 312/107 |
| 2,323,957 | 7/1943 | Zalkind | 312/107 |
| 3,729,241 | 4/1973 | Schippers et al. | 312/111 |
| 3,759,600 | 9/1973 | MacDonald | 312/257 R |
| 3,779,177 | 12/1973 | Gigante | 312/108 |
| 3,870,389 | 3/1975 | Killam | 312/111 |
| 3,973,371 | 8/1976 | Heller | 312/257 R |
| 4,077,686 | 3/1978 | Bukaitz | 312/107 |

*Primary Examiner*—Victor N. Sakran
*Attorney, Agent, or Firm*—Holman & Stern

[57] ABSTRACT

Elements designed for use in connection with furniture, interior fittings and like details, said elements being adaptable to form in assembled condition a surface coating on existing structures and to constitute by themselves such structures, said elements having a small thickness in relation to their surface area.

The elements, at least two of which are to be placed in one of two parallel planes, have projections arranged as spacing means between elements situated in one and the same plane, the interspace created between the elements by said spacing means being so formed that it constitutes an undercut sliding and/or supporting groove intended to coact with a per se known guiding rib in a drawer, a shelf or the like.

11 Claims, 16 Drawing Figures

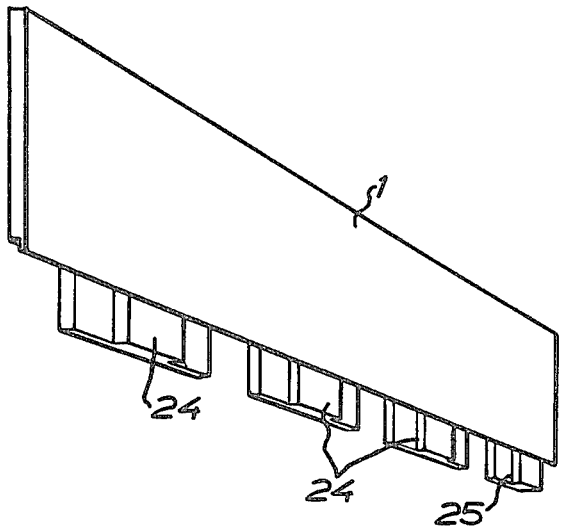
FIG. 9
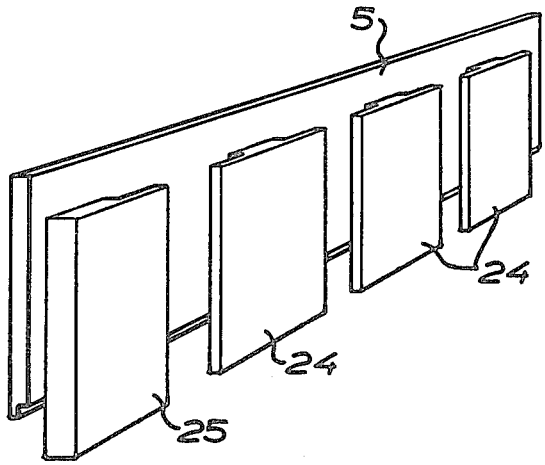

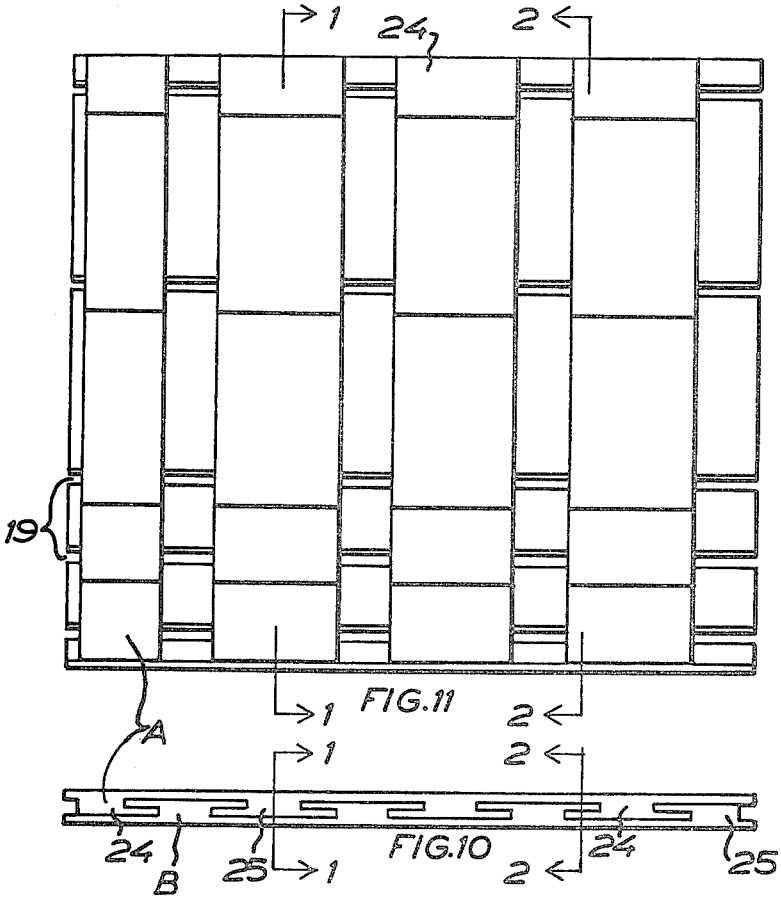
FIG.11
FIG.10
FIG.13
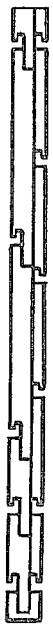
1-1

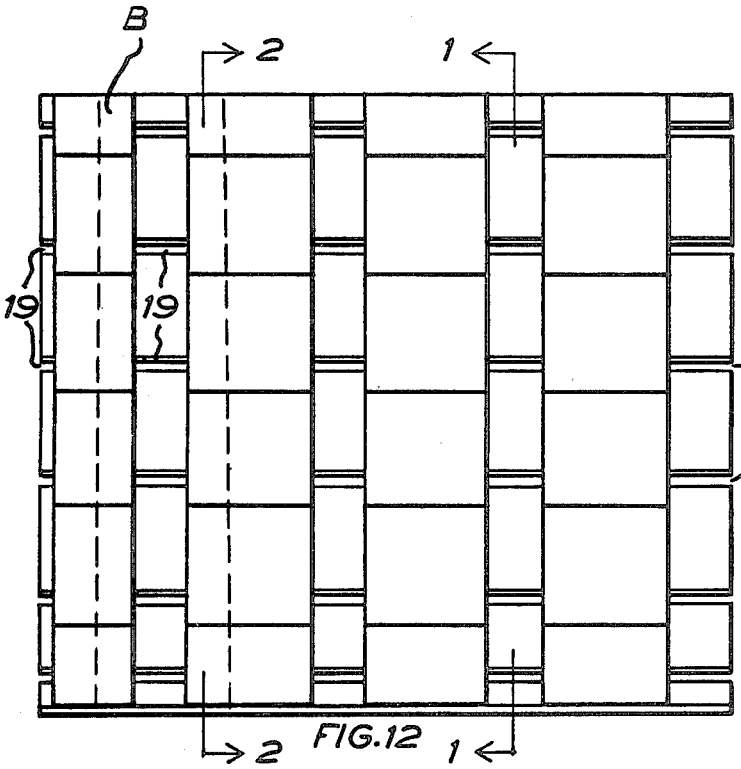
FIG.12
FIG.14
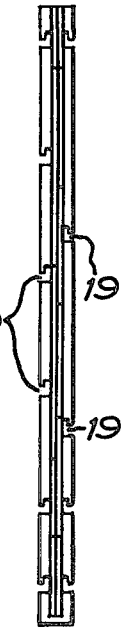
2-2

CONSTRUCTION ELEMENT FOR FURNITURE AND LIKE INTERIOR FITTING DETAILS

The present invention relates to a surface-coating and/or surface-forming element for furniture, interior fittings and like details, said element having a total thickness which is small in relation to the surface extent and having edges which are parallel in pairs.

The object of the invention is to provide an element by means of which e.g. the end walls of a piece of furniture and other interior furnishing details, such as independent or suspended units and fittings at and between existing wall sections or the like, may be arranged or completed so as to permit using the element as carrying means for drawers, shelves or like details.

The essential characteristic of the element according to the invention is that at least two such elements are adapted to be placed in a vertical plane and at least two such elements are intended to be placed in a plane which is spaced from said first plane and is parallel therewith, that said element has along one edge a projection serving as a spacing means relative to an adjacent element lying in the same plane and has along the opposite edge an abutment surface for a corresponding projection serving as a spacing means in another adjacent element, said two edges being for the rest so shaped that in two adjacent elements they form an undercut sliding and/or supporting slot adapted to coact with a per se known guide bar of a drawer, shelf or the like.

Examples of embodiment of the element according to the invention will be described in more detail hereinafter with reference to the accompanying drawings, in which:

FIG. 9 is a perspective view of two elements provided with interconnecting means;

FIG. 10 is a top view of an intermediate wall composed of elements according to FIG. 9 for a piece of furniture or like equipment;

FIG. 11 shows one side of said wall;

FIG. 12 shows the other side of the same wall;

FIG. 13 is a section on line 1—1 of FIGS. 10, 11 and 12;

FIG. 14 is a section on line 2—2 of FIGS. 10, 11 and 12; and

Figure 1:
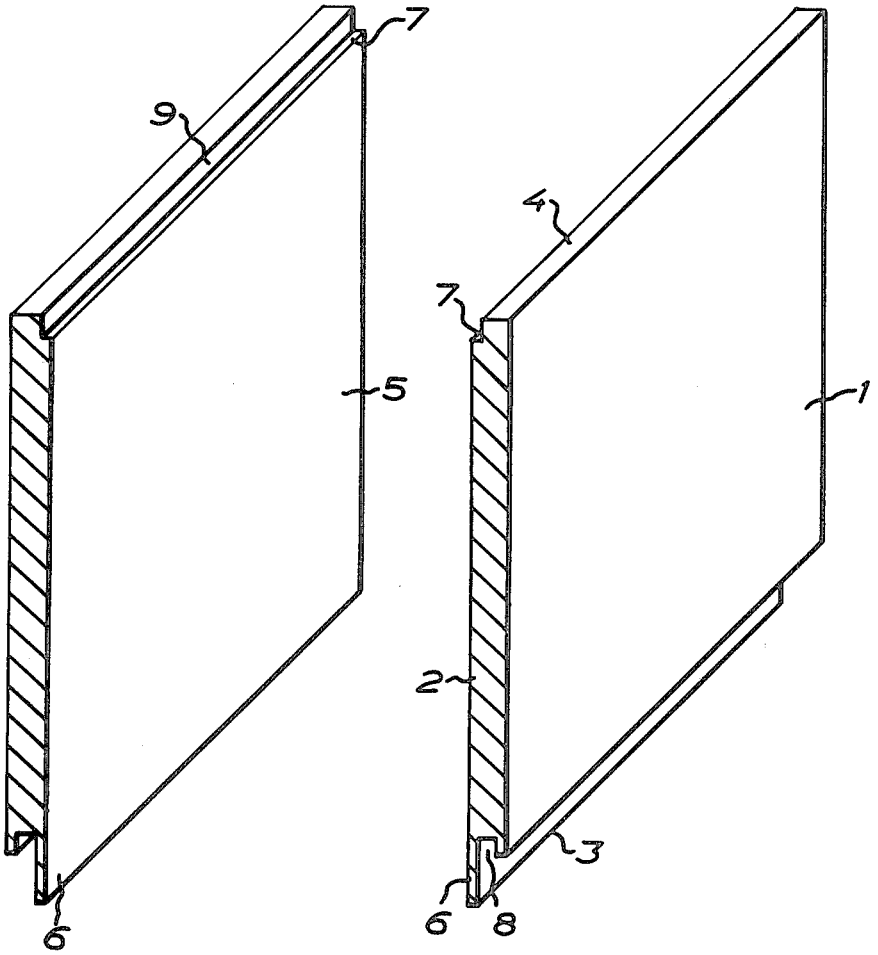
FIGS. 1–4 are perspective sectional views of various embodiments of the element according to the invention.
Figure 2:
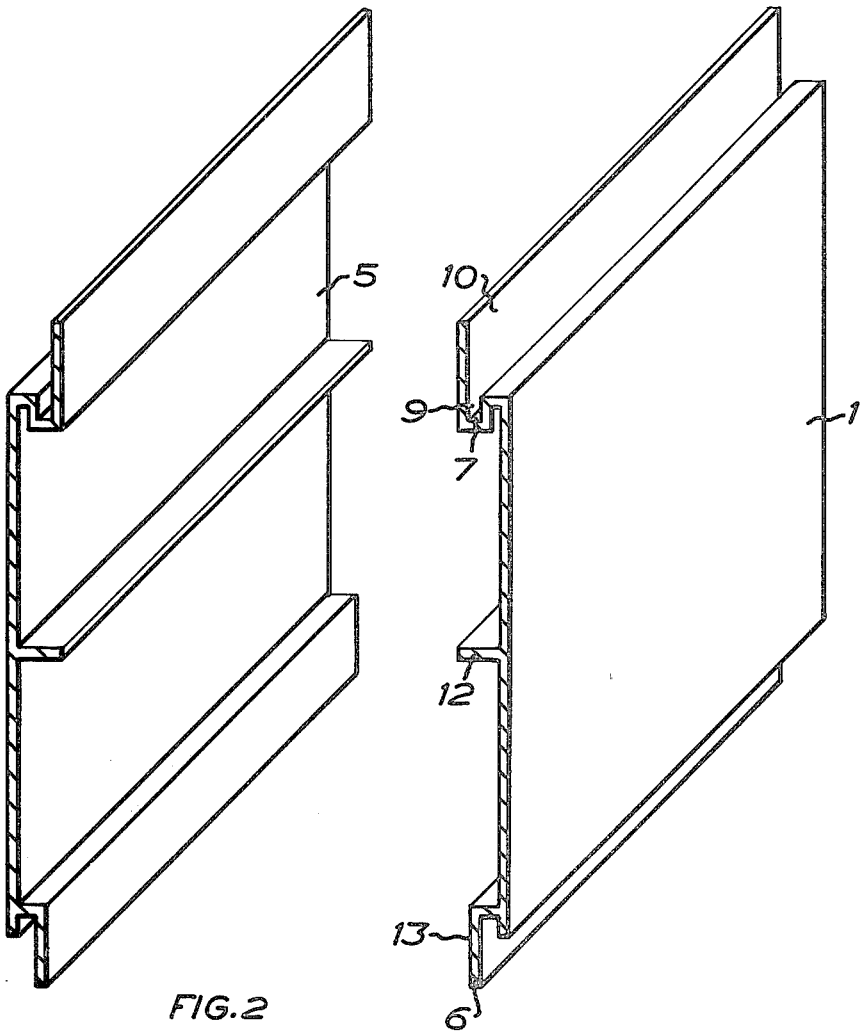
Figure 3:
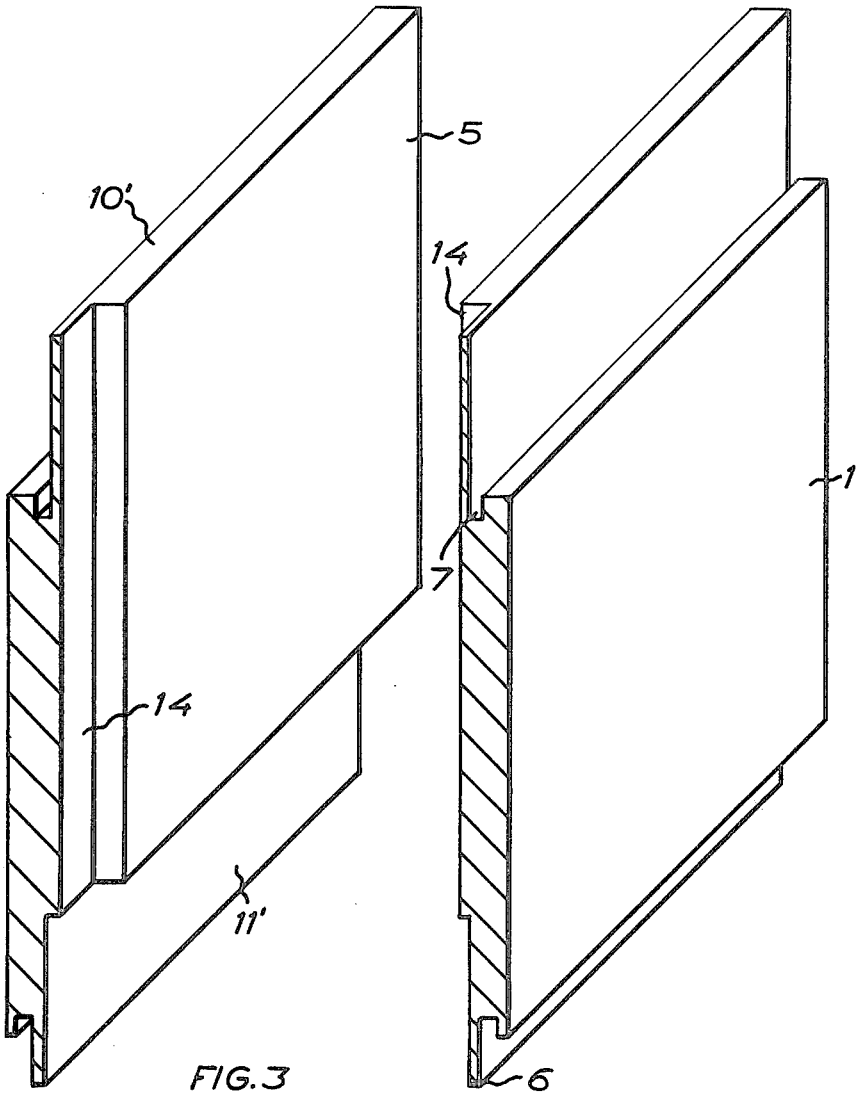
Figure 4:
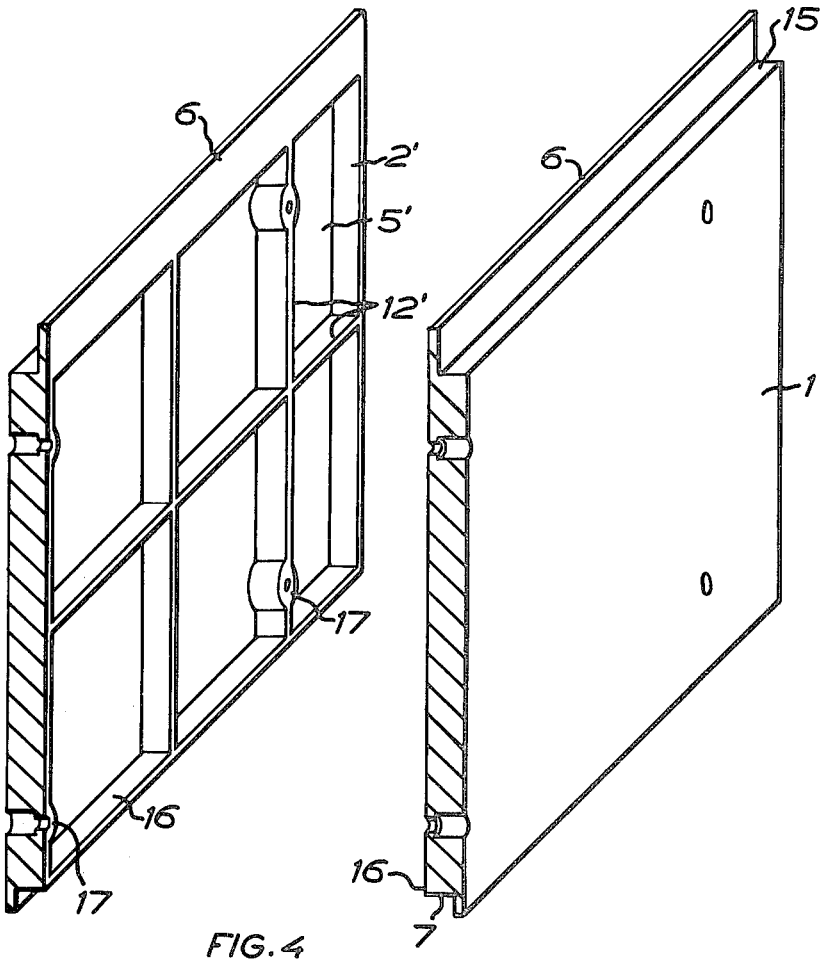

In FIG. 1 which, like FIGS. 2, 3 and 4, for the sake of clarity shows a pair of identical elements, the outside of the element is designated by 1, the end edges by 2, the side edges by 3 and 4, respectively, and the back side by 5.

At the lower side edge 3 of the element there is a projection 6 serving as a spacing means while there is an abutment surface 7 at the opposite side edge 4.

Parts of the element which are similar in form and function will be designated by the same reference numerals with added symbols indicating constructional differences.

In the embodiment of FIG. 1 the element is solid and may, for instance, be extruded. The projection 6 is offset from the central plane of the element and close to the projection is a slot 8 formed on the side of the projection facing the outside of the element. The slot 8 is designed to coact with a per se known guide bar for drawers, baskets and like elements.

In this embodiment the abutment surface 7 may be considered to form the bottom of a groove 9 receiving the edge portion of the spacing projection 6.

The embodiment according to FIG. 2 agrees in principle with the embodiment of FIG. 1 with the exception that the embodiment of FIG. 2 is not solid.

In this embodiment the groove 9 is delimited in the direction of the back side of the element by a tongue 10 which projects flush with a supporting rib 12 arranged on the back side of the element. The backwardly facing side 13 of the spacing projection 6 is spaced from the plane in which the backwardly facing edge of the supporting rib 12 and the back side of the tongue 10 are situated, by a distance corresponding to the thickness of the tongue 10, resulting in overlapping between the spacing projection 6 and the tongue 10.

Also in this embodiment the element may be extruded.

The embodiment of FIG. 3, according to which the element likewise may be extruded, differs from the embodiment of FIG. 1 in that the solid element has been made thicker and in that the tongue 10', which has thus become thicker than in FIG. 1, is higher. From this it follows that also the recess 11' is greater in height and depth. The element of FIG. 3 is to be used together with rods or swords adapted to stiffen the elements laterally and recesses 14 therefor have been formed in the short sides of the element in a separate moment.

The element according to FIG. 4, which preferably is to be made by injection moulding, is simplified as compared with the elements described above since the groove arranged at the abutment surface and the tongue with the corresponding recess have been dispensed with. Also the slot used as a separate detail for the drawer guide bar has been eliminated.

In this case, at one side edge of the element, which has assumed the form of a thin-walled box structure, the upper spacing projection 6 extends directly from the edge surface 15 which for the rest is plane.

At the opposite side edge, the edge surface proper which, besides, serves as an abutment surface 7, is formed of a retracted wall portion 16 beyond which the wall forming the front side of the element projects.

Arranged on the back side 5' of the element are stiffening ribs 12'. The elements are designed to be attached to each other or to a frame, an existing wall or the like by means of screws or similar fastening elements which are introduced through bores in taps 17 provided in the ribs.

Figure 5:
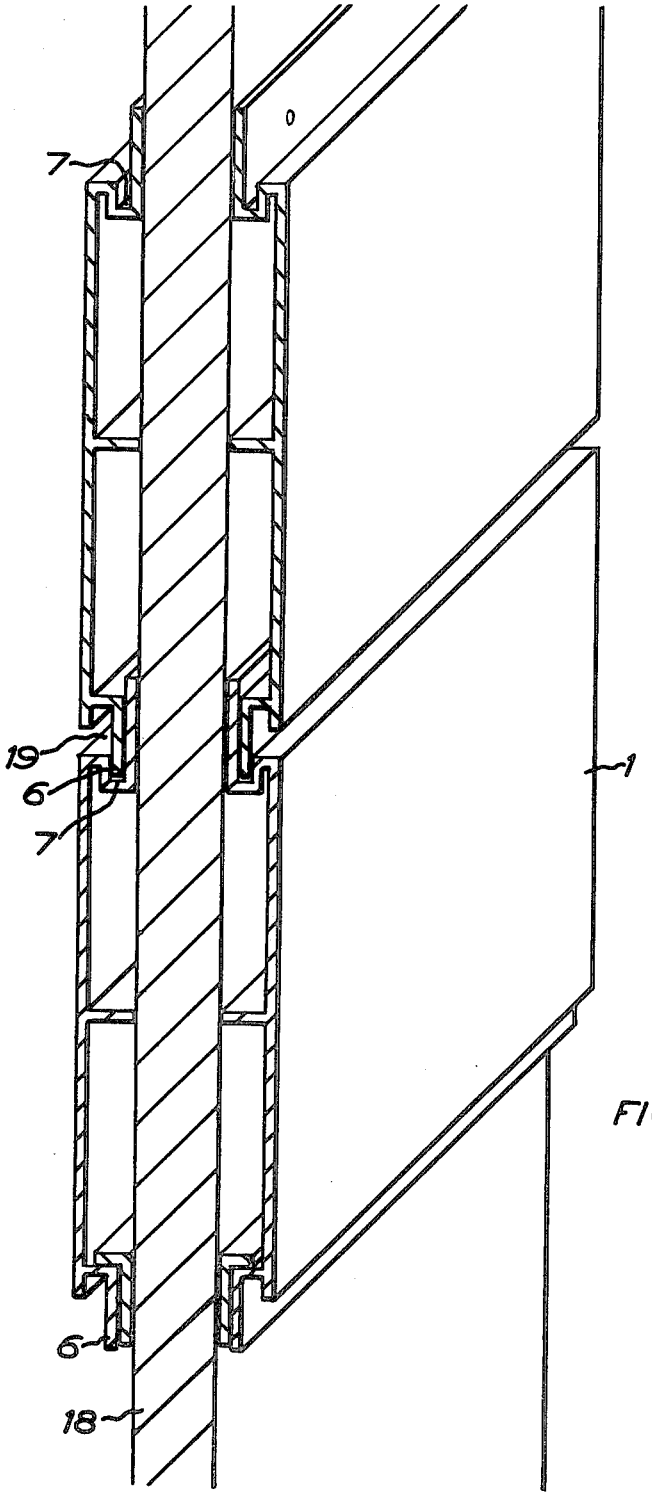
FIG. 5 is a perspective sectional view showing elements according to FIG. 2 mounted on a supporting structure.

FIG. 5 illustrates how the elements according to FIG. 2 are mounted adjacent each other with the aid of an intermediate supporting structure 18, which may consist of a cabinet wall or the like, and how slots 19 are formed between the elements for receiving drawers provided with guide ribs.

Figure 6:
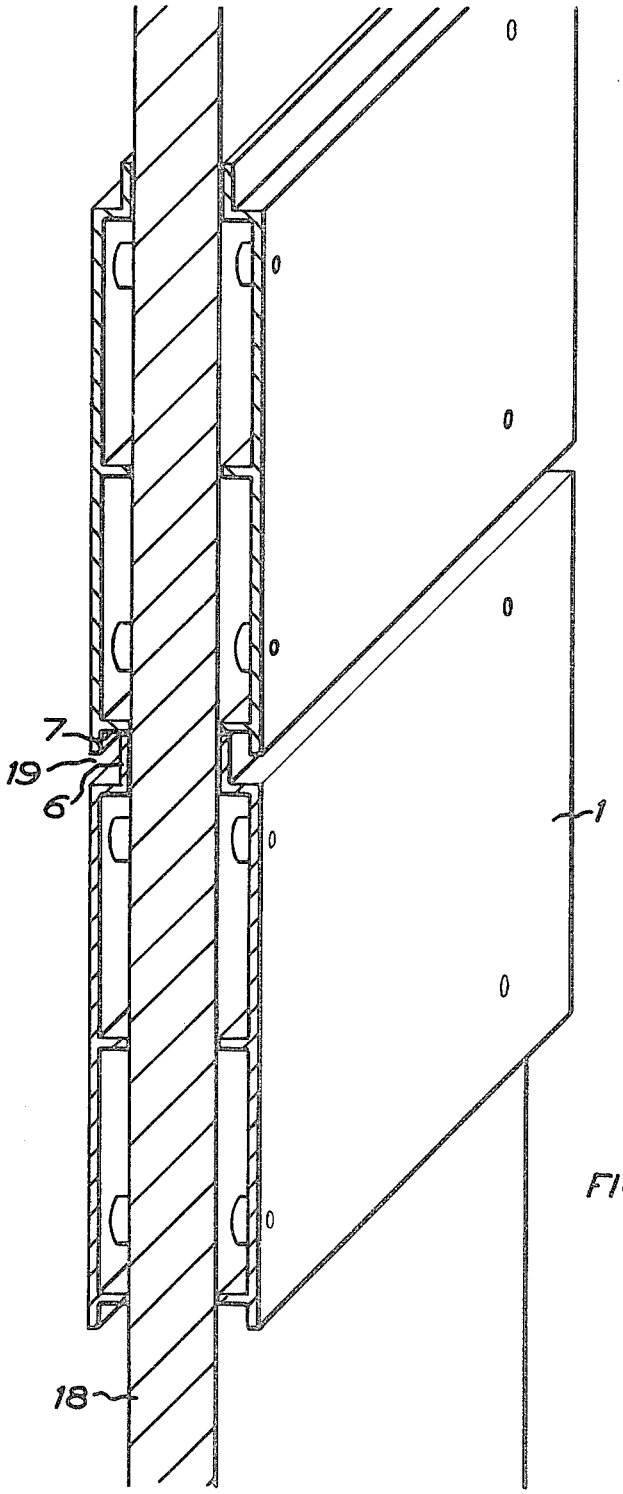
FIG. 6 is a perspective sectional view showing elements according to FIG. 4 mounted on a supporting structure.

FIG. 6 illustrates the method of mounting elements according to FIG. 4 on a supporting structure 18 of the type just mentioned, whereby slots 19, identical with the slots of FIG. 5, are formed also in this connection.

Figure 7:
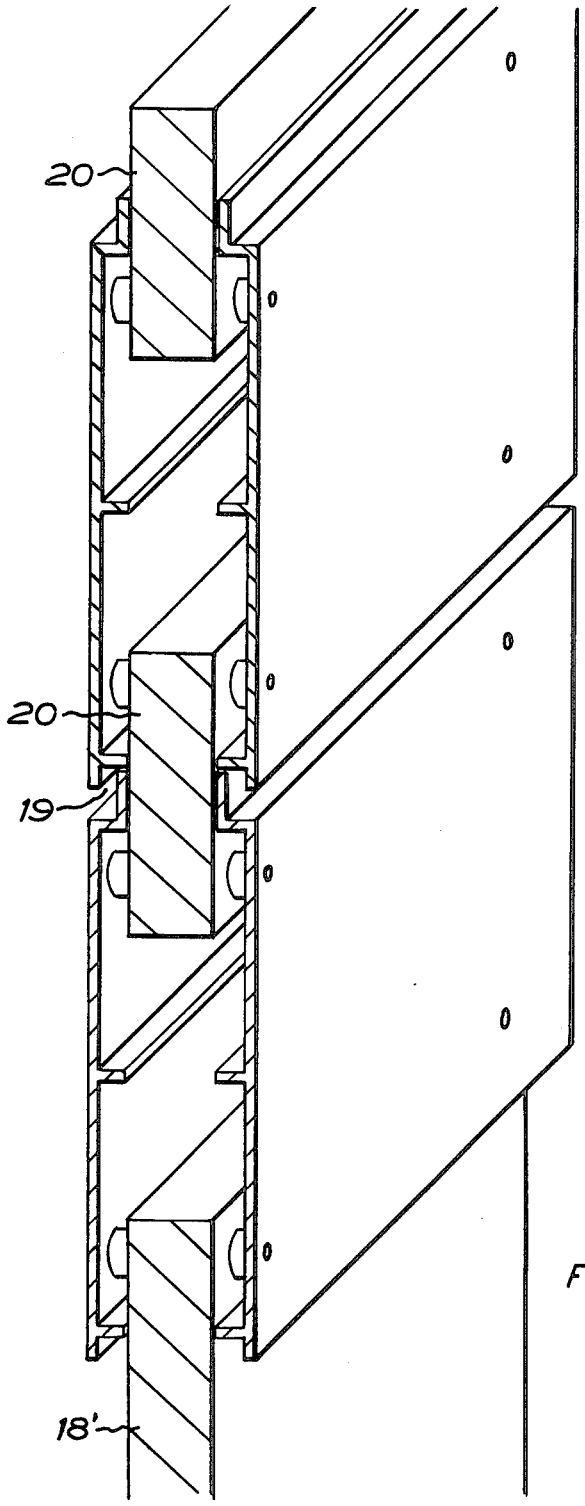
FIG. 7 is a perspective sectional view showing elements according to FIG. 4 joined by means of connecting members.

FIG. 7 shows how elements according to FIG. 4 together with connecting members 20 are brought to form a self-supporting construction which, in turn, is supported by a structural section 18'. The lowermost pair of elements are secured to the structural section 18' and are connected with the elements situated above them by means of the connecting member 20.

Figure 8:
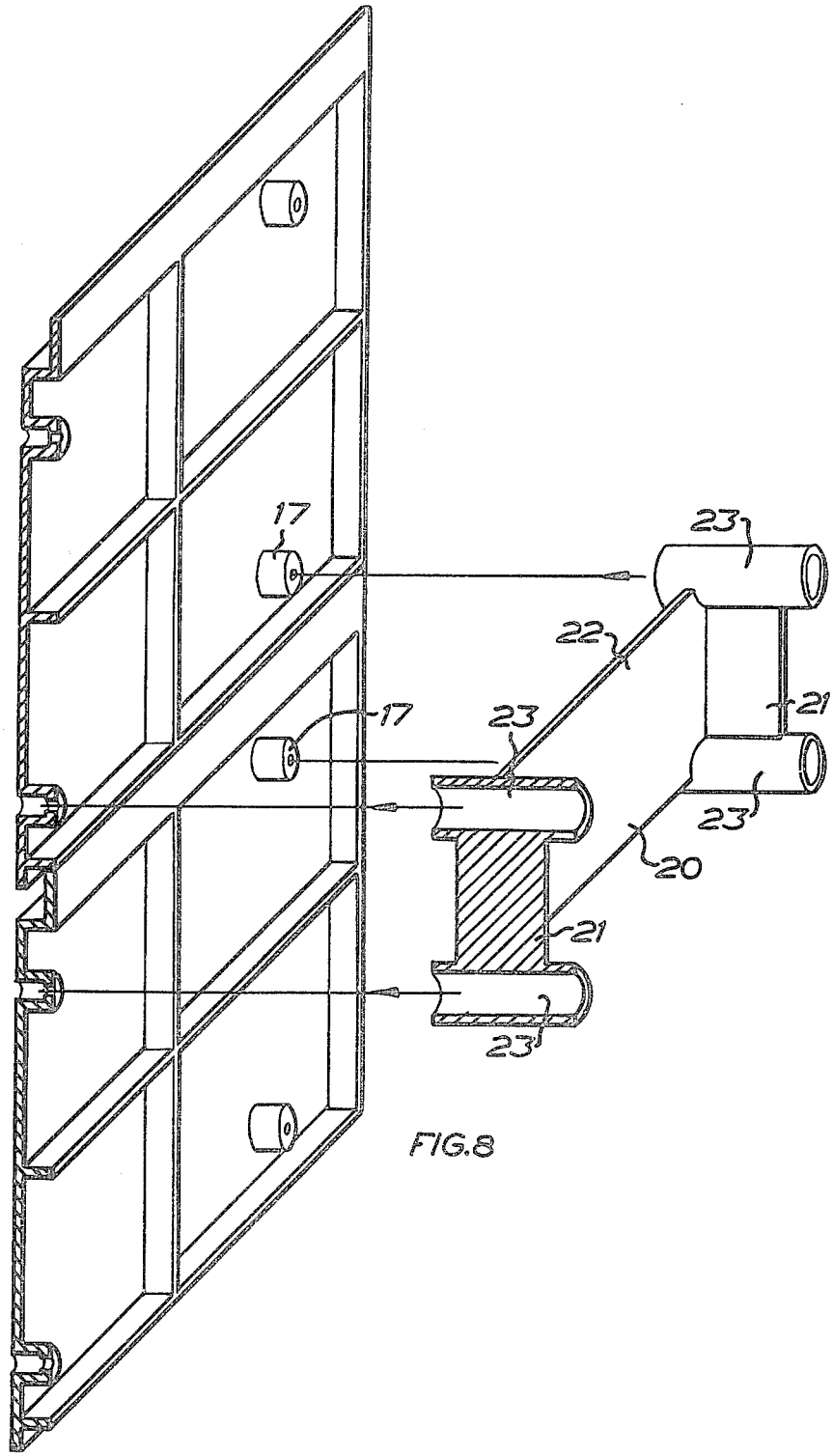
FIG. 8 is a perspective sectional view showing the element of FIG. 4 and connecting members for joining such elements.

FIG. 8 shows in cross-section a modified embodiment of a connecting element 20' which is adapted to coact with the element of FIG. 4. The connecting element 20' comprises a pair of flanges 21 which are joined by a web portion 22. Each flange is provided with two coupling sleeves 23 which are adapted to receive the taps 17 of two adjacent elements. The elements are fixed by means of screws or like fastening means extending through the bores in the taps and sleeves. To increase the lateral stability one may fit through-going stiffening verical rods at the short sides of the elements mounted above each other.

FIG. 9 shows a modified embodiment of elements according to FIGS. 1, 2, 3 or 4. The element halves are provided with complementary, generally T-shaped and L-shaped projections 24 and 25, respectively, extending in the vertical direction of the elements and being uniformly spaced from each other, said projections making it possible to connect two elements beside each other as well as below each other by vertical insertion. The projections are placed in the same way on all the elements, and an L-shaped projection is always placed at one short end.

From FIGS. 10–14 it is seen how it is possible to construct e.g. intermediate walls for furniture or interior fitting details by means of elements provided with the connecting ribs 24, 25, it being possible to place slots 19, designed for drawers, shelves or like elements, independently of each other on either side of the intermediate wall or detail. In FIG. 10 it is possible to distinguish the function of the interacting T- and L-shaped ribs 24 and 25. In FIGS. 11 and 12 the elements constituting side A and side B, respectively, are illustrated individually as seen from their respective insides.

Figure 15:
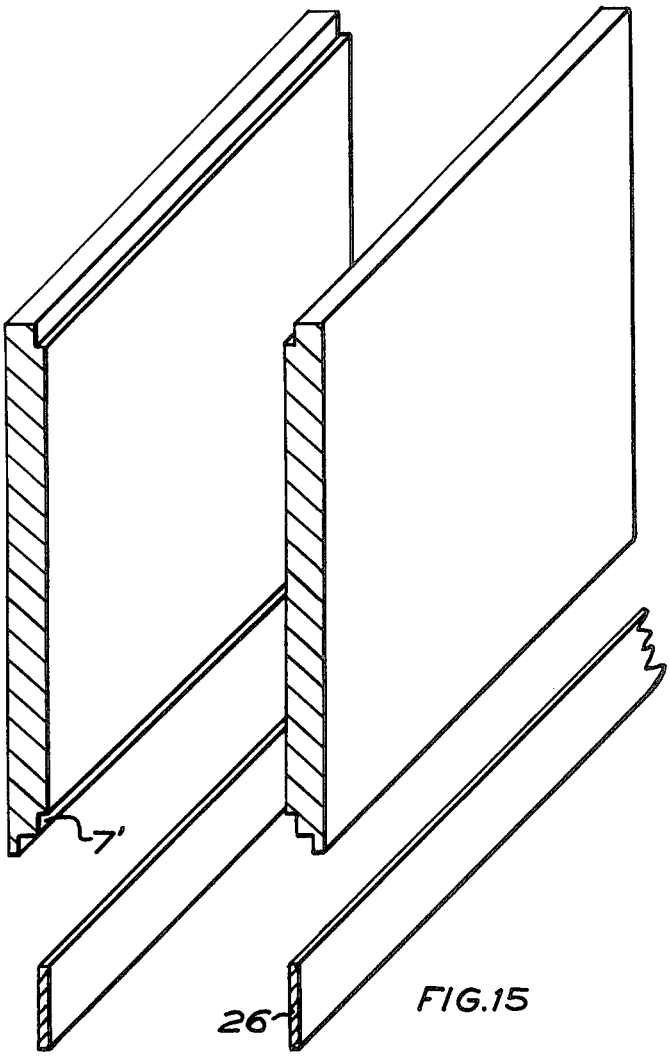
FIGS. 15 and 16 show alternative embodiments of the element of FIG. 1.

Under certain conditions it is desired that the elements formed have no fixed projections. FIG. 15 shows how an element has been provided with abutment surfaces 7 and 7' at both edges, the elements being adapted to coact with loose tongues 26 which, as the elements are mounted on the support or the like lying behind them, are fitted in at the abutment surfaces facing each other.

In case two elements are to be attached to each other with the back sides against each other it is of course possible to use, instead of two tongues, a single tongue of double thickness.

The elements may be further simplified by eliminating the projection extending downwardly at the lower edge of the front side and outwardly defining the slide slot or groove 8 or 19, whereby the elements will have exactly the same form at the upper and lower edges.

Figure 16:
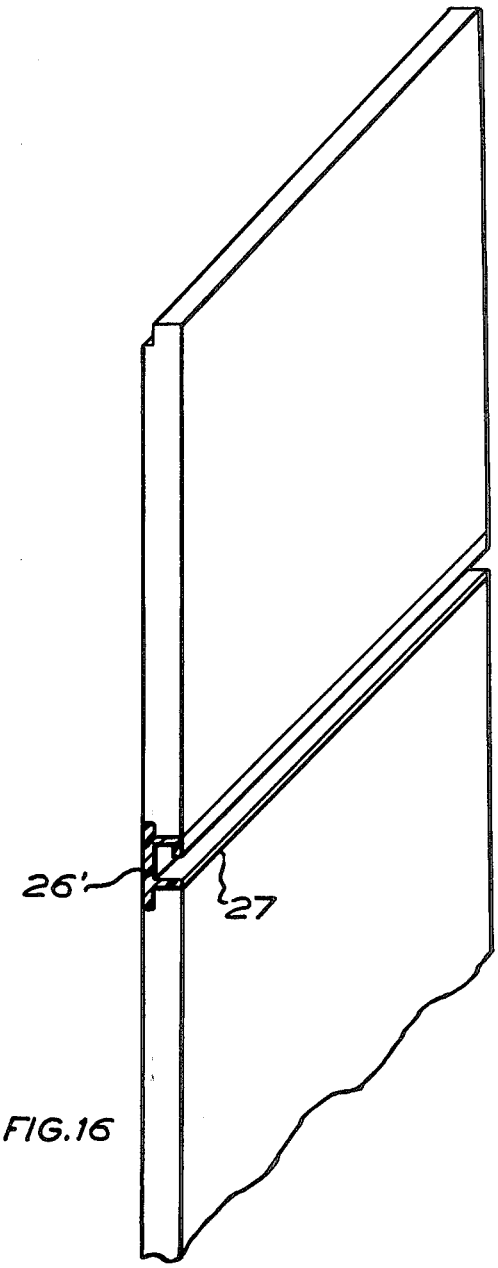

FIG. 16 shows an embodiment which is particularly suitable for elements prepared of a material having such surface characteristics that the friction in the slots 8 would become too high. Fitted between the interfacing upper and lower edge surfaces of the superposed elements is a separate slide rail 27 of resistant material with low friction. In the illustrated embodiment the slide rail is made integral with the tongue 26', whereby the slide rail will be fixed without special measures.

A slide rail of similar character may also be used in other types of elements, even in those having a fixed projection, the only modification being that the front edge projection is removed. The retention of the tongue may take place by providing the interfacing element edges with grooves which are engaged by heads on the outside of the slide rail, or the slide rail may be formed so as to have dovetailed cross-section while the element edges are inclined correspondingly.

It is obvious that, as far as embodiments of individual details are concerned, it is possible to make several modifications without therefore departing from the inventive idea.

Thus, the invention should not be considered restricted to that described above and shown in the drawings but it may be modified in various ways within the scope of the appended claims.

What we claim and desire to secure by Letters Patent is:

1. A surface-forming element for furniture, interior fittings, and like details, said element having a total thickness which is small in relation to the surface extent and having edges which are parallel in pairs, wherein at least two such elements are adapted to be placed in a vertical first plane and at least two such elements are intended to be placed in a second plane which is spaced from said first plane and is parallel therewith, and wherein an intermediate support member aids for supporting said elements in said first and second planes, each said element has along one edge a projection serving as a spacing means relative to an adjacent element lying in the same plane and has along the opposite edge an abutment surface for a corresponding projection serving as a spacing means in another adjacent element, said two edges being for the rest so shaped that in two adjacent elements they form an undercut supporting slot adapted to coact with a per se known guide bar in a drawer, shelf or the like.

2. Element as claimed in claim 1, wherein the abutment surface constitutes the bottom of a slot formed as a groove coacting with the outer portion of the projection serving as a spacing means.

3. Element as claimed in claim 1 or 2, wherein the elements on a side surface have means for joining such elements with each other with a supporting structure behind them.

4. Element as claimed in claim 3, wherein the means for joining the elements include generally T- and L-shaped undercut projections having flange ribs oriented in the vertical direction of the elements and extending on the back side thereof, the longitudinal extent of said projections being greater than the height of the elements, said ribs being adapted to coact with ribs of complementary shape arranged on other elements or on a supporting detail.

5. Element as claimed in claim 1, wherein the projection serving as a spacing member relative to the adjacent element is a loose detail which can be fitted in between the elements.

6. Element as claimed in claim 5, wherein the projection in the form of a loose detail has such an extension in depth that it constitutes a spacing means between elements arranged in two rows with the back sides facing each other.

7. Element as claimed in claim 1, wherein the undercut supporting groove is formed of a separately made detail which can be fitted between adjacent elements.

8. Element as claimed in claim 7, wherein te separate detail forming the supporting groove is made integral with a loose tongue which constitutes a spacing means between the elements.

9. A surface forming element for furniture, interior fittings, and like details, said element having a total thickness which is small in relation to the surface extent and having edges which are parallel in pairs, wherein at least two such elements are adapted to be placed in a vertical first plane and at least two such elements are intended to be placed in a second plane which is spaced from said first plane and is parallel therewith, each said element has along one edge a projection serving as a spacing means relative to an adjacent element lying in the same plane and has along the opposite edge an abutment surface for a corresponding projection serving as a spacing means in another adjacent element, said two edges being for the rest so shaped that in two adjacent elements they form an undercut supporting slot adapted to coact with a per se known guide bar in a drawer, shelf, or the like; said element which suitably is formed by injection moldingand is in the form of a box with very low or inconsiderable walls, is provided with bored taps which are fixed at the rear of the front side wall and bridge the distance between the rear of the front side wall and the plane in which the remote edge of the low side walls of the box-like element is situated, said taps being designed to constitute supporting and spacing means when the element is fixed to another element or to a supporting structure by means for fastening extending through the top bores.

10. Element as claimed in claim 9, wherein the taps are adapted to coact with coupling means provided with sleeves which are arranged in pairs for receiving the taps of adjacent elements.

11. A surface forming element for furniture, interior fittings, and like details, said element having a total thickness which is small in relation to the surface extent and having edges which are parallel in pairs, wherein at least two such elements are adapted to be placed in a vertical first plane and at least two such elements are intended to be placed in a second plane which is spaced from said first plane and is parallel therewith, each said element has along one edge a projection serving as a spacing means relative to an adjacent element lying in the same plane and has along the opposite edge an abutment surface for a corresponding projection serving as a spacing means in another adjacent element, said two edges being for the rest so shaped that in two adjacent elements they form an undercut supporting slot adapted to coact with a per se known guide bar in a drawer, shelf, or the like; said abutment constitutes the bottom of a slot formed as a groove coacting with the outer portion of said projection serving as said spacing means; said elements on a side surface have means for joining such elements with each other or with a supporting structure behind them, said means for joining includes generally T-shaped and L-shaped undercut projections having flange ribs oriented in the vertical direction of the elements and extending on the back side thereof, the longitudinal extend of said projections being greater than the height of the elements, said ribs being adapted to coact with ribs of complementary shape arranged on other elements or on a supporting detail; said T-shaped undercut projections, in a number adjusted to the length of the element, are arranged on each of the elements, the projection situated adjacent one end of the element being spaced from said end, a L-shaped undercut projection being arranged at the opposite end, the flangeless side of the web portion of the L-shaped projection being situated in the same plane as the element end.

* * * * *